US010710104B2

(12) United States Patent
Jurczyszak et al.

(10) Patent No.: US 10,710,104 B2
(45) Date of Patent: Jul. 14, 2020

(54) LIQUID FLOW DEVICE

(71) Applicant: EEMAX, INC., Waterbury, CT (US)

(72) Inventors: Eric Robert Jurczyszak, Berlin, CT (US); Lejsan Jusufi, Naugatuck, CT (US); Curtis Keohane, Middletown, CT (US); Christopher Mark Hayden, Shelton, CT (US); Sergiu Gabriel Mihu, Newtown, CT (US)

(73) Assignee: EEMAX, INC., Waterbury, CT (US)

( * ) Notice: Subject to any disclaimer, the term of this patent is extended or adjusted under 35 U.S.C. 154(b) by 220 days.

(21) Appl. No.: 15/887,608

(22) Filed: Feb. 2, 2018

(65) Prior Publication Data

US 2019/0118196 A1 Apr. 25, 2019

Related U.S. Application Data

(60) Provisional application No. 62/575,135, filed on Oct. 20, 2017.

(51) Int. Cl.

| | |
|---|---|
| ***B05B 1/34*** | (2006.01) |
| ***E03C 1/08*** | (2006.01) |
| ***F24H 9/00*** | (2006.01) |
| ***E03C 1/044*** | (2006.01) |

(52) U.S. Cl.

CPC ..... *B05B 1/3421* (2013.01); *B05B 1/3402* (2018.08); *B05B 1/3463* (2013.01); *E03C 1/044* (2013.01); *E03C 1/08* (2013.01); *F24H 9/0005* (2013.01)

(58) Field of Classification Search

CPC ... B05B 1/3421; B05B 1/3402; B05B 1/3463; E03C 1/044; E03C 1/08; F24H 9/0005

USPC ..... 239/428.5, 461–463, 490, 552, 239/590–590.5, 135

See application file for complete search history.

(56) References Cited

U.S. PATENT DOCUMENTS

| | | | | |
|---|---|---|---|---|
| 2006/0102757 | A1* | 5/2006 | Johnson | B05B 12/06 239/590.3 |
| 2006/0151635 | A1* | 7/2006 | Laker | B05B 1/1609 239/552 |
| 2013/0221132 | A1* | 8/2013 | Egli | B05B 1/26 239/490 |

* cited by examiner

*Primary Examiner* — Steven J Ganey
(74) *Attorney, Agent, or Firm* — Troutman Sanders LLP

(57) ABSTRACT

A liquid flow device to receive fluid and laminarize the fluid flow. The liquid flow device includes a jet nozzle assembly to receive the fluid and direct the fluid through a plurality of jet channels and a flow disruptor assembly to receive the fluid from the jet nozzle assembly to generate a flow path of the fluid. The liquid flow device also includes a chamber assembly connected to the flow disruptor to receive the fluid from the flow disruptor assembly and an outlet assembly, open to an external environment to receive the fluid from the chamber assembly and output the fluid with a laminar flow pattern.

19 Claims, 15 Drawing Sheets

ADD exploted view

LIQUID FLOW DEVICE

CROSS-REFERENCE TO RELATED APPLICATION

This application claims the benefit of U.S. Provisional Application No. 62/575,135, filed Oct. 20, 2017, the entirety of which is herein incorporated by reference.

BACKGROUND

Fluid heating systems, such as water boilers, can provide and dispense hot fluids through dispensing outlets, such as faucets, that are under atmospheric pressure. When a hot fluid is released through the dispensing outlets splashing and/or spraying can occur which can be energy inefficient and/or dangerous. For example, a portion of the hot fluid can be lost and/or dangerously hot fluid can come into contact with a user or bystander.

Conventional laminar flow aerators present important drawbacks. Notably, for superheated fluid applications in which the hot fluid is no longer simply used in low energy applications, e.g. warm water, but is instead used in high energy applications, e.g. cooking, cleaning, sterilizing, or the like, the fluid is heated such that the hot fluid is no longer homogenous and becomes a mixture of superheated water, steam and/or water vapor. The hot fluid remains liquid under pressure until atmospheric pressure conditions are met when the hot fluid is released through the dispensing outlets and can change into steam upon depressurization. Gaseous pockets, e.g. steam and/or water vapor that are compressed in pipes, can rapidly expand upon exiting to the dispensing outlets. The expansion has enough energy to splash and/or spray the hot fluid at significant distances which presents a danger of scalding users of and/or bystanders. Therefore, a conventional laminar aerator cannot handle such a release of energy thereby rendering it inefficient and/or useless for such applications.

SUMMARY

In an exemplary fluid heating system, the system dispenses heated fluid without splashing and/or spraying by separating, decompressing, and reducing the velocity and/or reducing the kinetic energy of liquid flowing within the system. Through wetting and/or swirling motions, the system expands and separates gaseous vapor and steam to reduce turbulence of the heated fluid thereby inducing laminar flow of fluid.

In one non-limiting illustrative example, a liquid flow device to receive fluid and induce laminar fluid flow is described. The liquid flow device includes a jet nozzle assembly to receive the fluid and direct the fluid through a plurality of jet channels and a flow disruptor assembly to receive the fluid from the jet nozzle assembly to generate a flow path of the fluid. The liquid flow device also includes a chamber assembly connected to the flow disruptor to receive and expand the fluid from the flow disruptor assembly and an outlet assembly open to an external environment to receive the fluid from the chamber assembly and output the fluid with a laminar flow pattern.

In another non-limiting illustrative example, a liquid dispensing system is described. The liquid dispensing system includes a heating device to receive fluid and output a heated fluid and a liquid flow device configured to receive and expand the heated fluid from the heating device and induce laminar flow of the heated fluid. The liquid flow device includes a jet nozzle assembly to receive the heated fluid from the heating device and direct the heated fluid through a plurality of jet channels and a flow disruptor assembly to receive the heated fluid from the jet nozzle assembly to generate a flow path of the heated fluid. The liquid flow device also includes a chamber assembly connected to the flow disruptor to receive the heated fluid from the flow disruptor assembly and an outlet assembly open to an external environment to receive the heated fluid from the chamber assembly and output the heated fluid with a laminar flow pattern.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
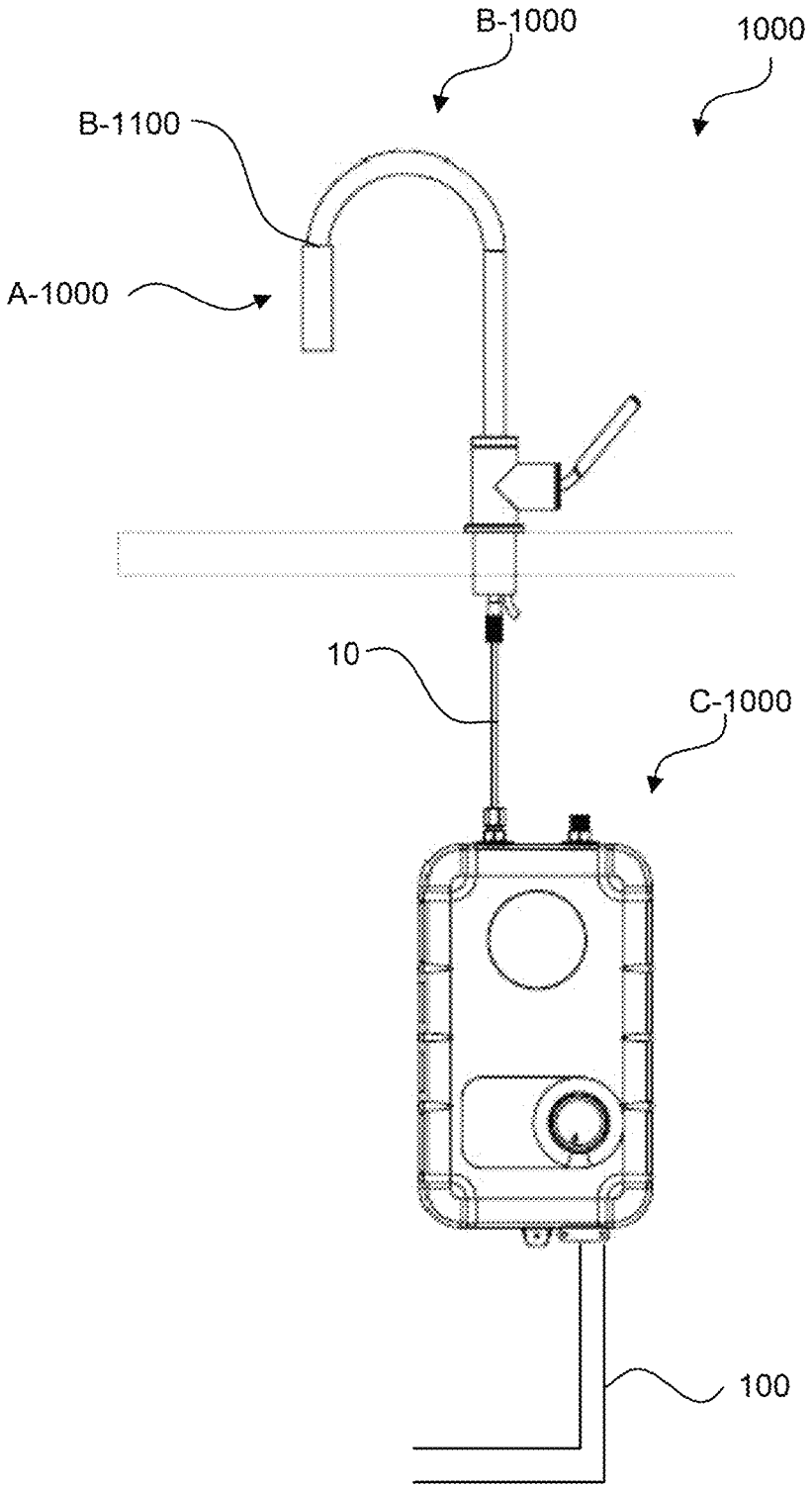
FIG. 1 is a view of a liquid dispensing system, according to certain aspects of the disclosure.

All publications, patent applications, patents, and other references mentioned herein are incorporated by reference in their entirety. Further, the materials, methods, and examples discussed herein are illustrative only and are not intended to be limiting.

In the drawings, like reference numerals designate identical or corresponding parts throughout the several views. Further, as used herein, the words "a", "an", and the like include a meaning of "one or more", unless stated otherwise. The drawings are generally drawn not to scale unless specified otherwise or illustrating schematic structures or flowcharts.

FIG. 1 is a side view of a liquid dispensing system 1000, according to certain aspects of the disclosure. The fluid heating system 1000 outputs a heated fluid 10 and releases the heated fluid 10 at atmospheric pressure without splashing and/or spraying by forcing the heated fluid 10 to expand, wet solid surfaces, and flow in laminar fashion. Although described herein as heated fluid 10, the fluid heating system 1000 may also provide unheated fluid or fluid at any temperature while also providing the same advantageous effect of laminar water flow.

The liquid dispensing system 1000 can include a liquid heating device C-1000 that receives fluid, e.g. water, from a supply line 100 and outputs heated fluid 10, e.g. water above 30° C., a liquid dispensing device B-1000 as would be understood by one of ordinary skill in the art, e.g. a faucet, that receives the heated fluid 10 and dispenses the heated fluid 10, a dispensing outlet assembly B-1100, and a liquid flow device A-1000 connected to the dispensing outlet assembly B-100 and configured to receive the heated fluid 10, laminarize the heated fluid 10, and dispense the heated fluid 10 at atmospheric pressure without splashing and/or spraying.

The term "laminarize" is used to describe that the flow of heated fluid 10 transitions from flowing in a non-laminar manner (e.g. turbulent flow unpredictable change in pressure, directions, and velocities) to flowing in a substantially laminar flow (e.g. in parallel layers with substantially no disruption and/or interaction between the layers).

The liquid heating device C-1000 can be any device that heats the fluid, e.g. water heaters, hot water heaters, hot water tanks, boilers, heat exchangers, or the like. For example, the liquid heating device C-1000 can be a water heating system, as described in at least one of U.S. Pat. Nos. 6,909,843 B1, 7,779,790 B2, 9,234,674, 9,702,585 and U.S. application Ser. No. 13/943,495, the entirety of each of which is incorporated herein by reference.

The liquid heating device C-1000 can generate the heated fluid 10, e.g. energized fluid in a liquid state, a gaseous state, or a mixture of both such as a mixture of superheated water, steam and/or water vapor. The heated fluid 10 can then be output by the liquid flow device A-1000 at atmospheric pressure without splashing and/or spraying thereby allowing enhanced and safer applications in high energy applications such as cooking, cleaning, sterilizing, or the like.

FIGS. 2A-2F are a side view, a top perspective view, a bottom view, a bottom perspective view, a sectional view, and a sectional view with streamlines of the liquid flow device A-1000 of the liquid dispensing system 1000, according to certain aspects of the disclosure.

The liquid flow device A-1000 can include an inlet assembly A-1100 connectable to the liquid dispensing device B-1000 (see FIG. 3) a jet nozzle assembly A-1200 that extends the inlet assembly A-1100 (see FIG. 3) a flow disruptor assembly A-1300 that extends the jet nozzle assembly A-1200, a chamber assembly A-1400 that extends the flow disruptor assembly A-1300, a vent assembly A-1500 that opens the flow disruptor assembly A-1300 to an outer environment, a screen assembly A-1600 partially closing the chamber assembly A-1400, and an outlet assembly A-1700 open to the outer environment.

In addition, one or more supplementary screens may be added to the liquid flow device A-1000 and positioned adjacently or spaced apart from the screen assembly A-1600 with a predetermined distance from the screen assembly A-1600 to further induce laminar flow. Furthermore, one or more supplementary screens may be oriented with a predetermined angle and/or have predetermined meshing configuration and/or size that are offset from the screen assembly A-1600 to further induce laminar flow.

As used herein, the terms "top" and/or "upper" refer to the region of the liquid flow device A-1000 closest to the dispensing outlet assembly B-1100 of the liquid dispensing device B-1000, the terms "bottom" and/or "lower" refer to the region of the liquid flow device A-1000 closest to an outlet lower opening A-1730, the term "inner" refers to the region of the liquid flow device A-1000 closest to a central axis Z of the flow liquid device A-1000, and the term "outer" refers to the region of the liquid flow device A-1000 farthest to the central axis Z.

Figure 3:
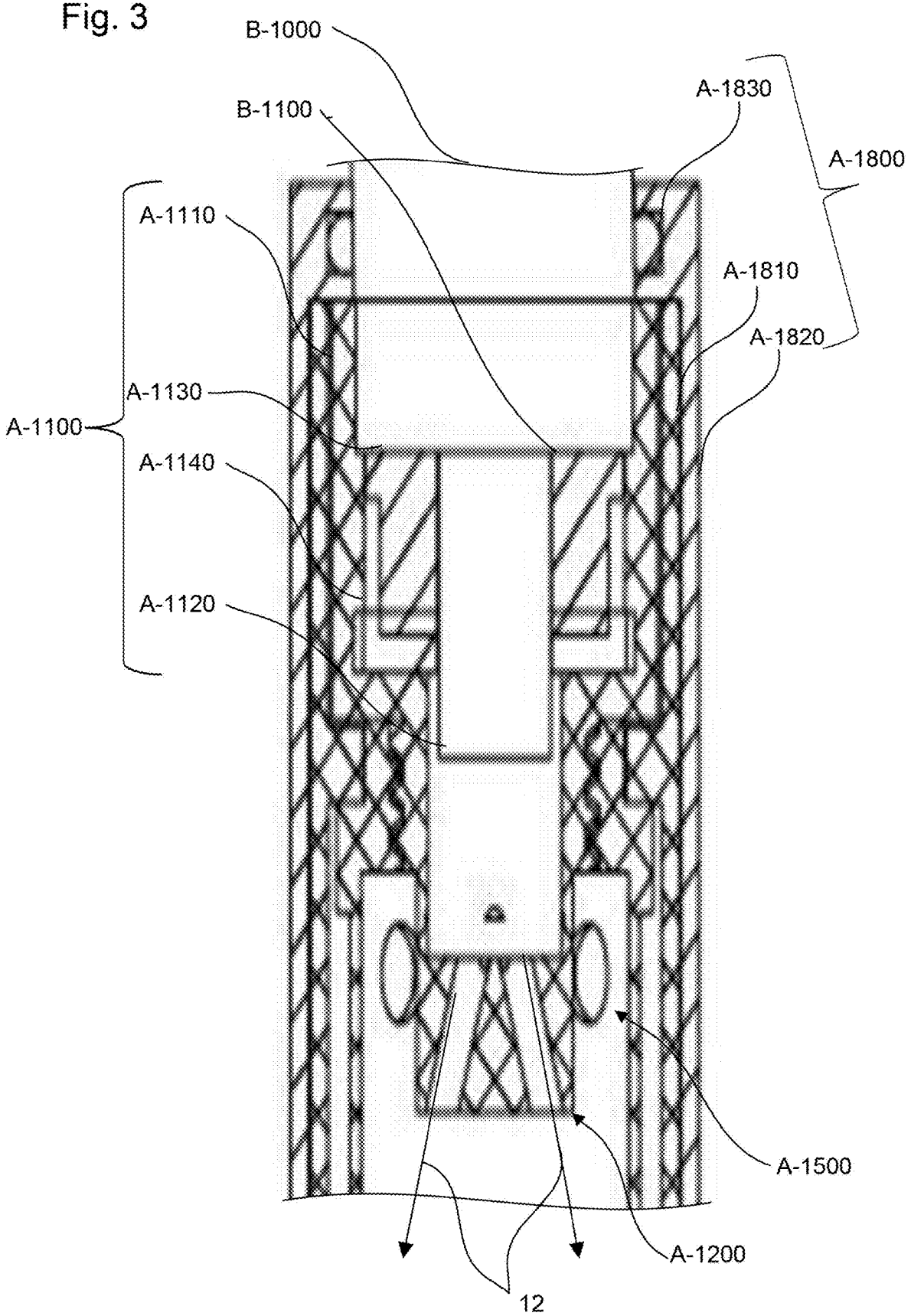
FIG. 3 is a sectional view of an inlet assembly of the liquid flow device, according to certain aspects of the disclosure.

The inlet assembly A-1100 can provide attachment between the liquid flow device A-1000 and the liquid dispensing device B-1000 at the dispensing outlet assembly B-1100, as illustrated in FIG. 3.

The jet nozzle assembly A-1200 can receive the heated fluid 10 under the form of a mixture of liquid and gas from the inlet assembly A-1100 (see FIG. 3), force the heated fluid 10 through plurality of jet channels A-1240 to generate a plurality of jets 12 of the heated fluid 10 that hit the flow disruptor assembly A-1300, and provide expansion of the heated fluid 10.

The flow disruptor assembly A-1300 can receive the jets 12 of the heated fluid 10 generated by the jet nozzle assembly A-1200 via the plurality of jet channels A-1240 to expand the heated fluid 10. The expansion of the heated fluid 10 provides separation between the liquid and gases contained in the heated fluid 10. The gases rise to an upper portion of the liquid flow device A-1000.

The vent assembly A-1500 can provide evacuation paths for the gases present in the heated fluid 10 from the flow disrupter assembly A-1300 via vent holes A-1510 to the outer environment.

The chamber assembly A-1400 can receive the heated fluid 10 from the flow disruptor assembly A-1300 and channel the heated fluid 10 towards the screen assembly A-1600 through swirling motions, e.g. streamlines generated by the flow of the heated fluid 10 that swirl within the chamber assembly A-1400 and move downwardly towards, the screen assembly A-1600 as illustrated in FIG. 3D, that wet the chamber assembly A-1400 and laminarize the heated fluid 10. Therefore, the chamber assembly A-1400 causes the heated fluid 10 to take a particular flow path which reduces flow disruptions within the liquid flow device A-1000.

The screen assembly A-1600 can receive the heated fluid 10 from the chamber assembly A-1400, provide wetting, and further laminarize the heated fluid 10. In addition, the screen assembly A-1600 can impede passage from the chamber assembly A-1400 to the outlet assembly A-1700 of the gases present in the heated fluid 10 and prevent the gases from being, released to the outer environment through the outlet assembly A-1700. These gases remaining in the flow path of the heated fluid 10 and gases existing after contact of the heated fluid 10 with the disrupter assembly A-1300 are evacuated to the outside environment via the vent holes A-1510 of the vent assembly A-1500. The outer environment, however, is in this example is provided within the liquid flow device A-1000 proximate to vent holes A-1510 via the shield assembly A-1800 (see FIG. 3). However, as described further herein in select embodiments, the shield assembly A-1800 may not be employed in which case the outer environment would not be enclosed and would be outside an exterior of the liquid flow device A-1000.

The outlet assembly A-1700 can receive the heated fluid 10 from the screen assembly A-1600 and canalize the heated fluid 10 to the outer environment where the heated fluid 10 is then released at atmospheric pressure without splashing and/or spraying. Therefore, the liquid dispensing device B-100 can be employed be in high energy applications in a safe and efficient way.

The flow disruptor assembly A-1300 can include a disruptor upper opening A-1310 that receives the jet nozzle assembly A-1200, a disruptor lower opening A-1330 that faces the disruptor upper opening A-1310 and opens up to the chamber assembly A-1400, and the disruptor body A-1320 that extends between the disruptor upper opening A-1310 and the disruptor lower opening A-1330.

The disruptor body A-1320 cart include a disruptor body inner surface A-1322 that is positioned peripherally around the jet nozzle assembly A-1200 to receive the jets 12 of liquid 10 generated by the jet nozzle assembly A-1200 and to provide expansion and separation of the gases present in the heated fluid 10. In addition, impacts generated by the jets 12 of liquid 10 onto the disruptor body inner surface A-1320 forces the heated fluid 10 to wet the disruptor body inner surface A-1320 in a swirling motion.

The vent assembly A-1500 can include one or more vent holes A-1510 positioned radially through the disruptor body A-1320, above contact areas between the jets 12 and the disruptor body inner surface A-1322, and that go through the disruptor body A-1320.

The chamber assembly A-1400 can include a chamber upper opening A-1410 that faces the disruptor lower opening A-1330, a chamber lower opening A-1430 that faces the outlet upper opening A-1710 of the outlet assembly A-1700 and a chamber body A-1420 that extends between the chamber upper opening A-1410 and the chamber lower opening A-1430.

The chamber body A-1420 can include a chamber body upper portion A-1422 that receives the heated fluid 10 through the chamber upper opening A-1410 and provides further expansion of the heated fluid 10, and a chamber body lower portion A-1426 extending between the chamber body upper portion A-1422 and the chamber lower opening A-1430 that receives the heated fluid 10 and converges the heated fluid 10 towards the outlet assembly A-1700.

The chamber body upper portion A-1422 can include a chamber body upper inner surface A-1424 that receives the heated fluid 10. The chamber body upper inner surface A-1424 can have a substantially cylindrical shape to provide further extension and condensation of the gases present in the heated fluid 10 as well as extend the swirling flow of the heated fluid 10 generated by the jets 12 towards the chamber body lower portion A-1426.

The chamber body lower portion A-1426 can include a chamber body lower inner surface A-1428 that receives and canalizes the heated fluid 10 towards the outlet upper opening A-1710. The chamber body lower portion A-1426 can have a substantially frusto-conical shape to canalize the heated fluid 10 from the chamber body upper portion A-1424 to the outlet assembly A-1700.

In addition, the chamber body upper portion A-1424 can be characterized by an internal diameter Dcb sufficiently large to allow the heated fluid 10 to expand thereby allowing for full separation of gas and liquid during the expansion of the fluid. Further, the chamber body lower portion A-1426 can have a tapered shape, with respect to the chamber body up portion A-1424, which is configured to collect the heated fluid 10 and prevent splashes, droplet formation, and/or uneven fluid distribution.

The outlet assembly A-1700 can include the outlet upper opening A-1710 that supports the screen assembly A-1600, an outlet lower opening A-1730 that opens to the outer environment to expel the liquid 10, and an outlet channel A-1720 that extends from the outlet upper opening A-1710 to the outlet lower opening A-1730 to canalize the heated fluid 10 from the screen assembly A-1600 to the outer environment. The outlet channel A-1720 can have a substantially cylindrical cross section to further laminarize the heated fluid 10.

The inlet assembly A-1100, the jet nozzle assembly A-1200, and the screen assembly A-1600 of the liquid flow device A-1000 are described in more details in the following paragraphs and figures.

FIG. 3 is a sectional view of the inlet assembly of the liquid flow device A-1000, according to certain aspects of the disclosure. The inlet assembly A-1100 can provide attachment and detachment between the liquid flow device A-1000 and the liquid dispensing device B-1000.

The inlet assembly A-1100 can include a jet nozzle housing A-1110 affixed on one end onto the liquid dispensing device B-1000 and attached on another end to the jet nozzle assembly A-1200, and a faucet flow conveying tube A-1120 that extends from the fluid dispensing device B-1000 towards the jet nozzle assembly A-1200. The inlet assembly A-1100 can also include an alignment bushing A-1130 positioned around the faucet flow conveying tube A-1120 of the liquid dispensing device B-1000 and a nozzle gasket A-1140 seated between the alignment bushing A-1130 and the jet nozzle housing A-1110.

The liquid flow device A-1000 can also include a shield assembly A-1800 that prevents gases from escaping upwards from the liquid flow device A-1000 and prevents splashing when the heated fluid 10 escape through the vent assembly A-1500. The shield assembly A-1800 also provides thermal insulation around the liquid flow device A-1000.

The shield assembly A-1800 can include a shield insulating sheath A-1810 that encloses the liquid flow device A-1000, a shield outer sheath A-1820 that encloses and contacts the shield insulating sheath A-1810, and a shield outer sheath ring A-1830 positioned between the dispensing outlet assembly B-1100 of the liquid dispensing device B-1000 and an upper portion of the shield outer sheath A-1820.

The shield insulating sheath A-1810 can cover outer surfaces of the inlet assembly A-1100, the jet nozzle assembly A-1200, and the flow disruptor assembly A-1300, and the chamber assembly A-1400 to provide thermal insulation and prevent splashing.

The shield outer sheath A-1820 can cover outer surfaces of the shield insulating sheath A-1810 and the liquid dispensing device B-1000 to further enhance thermal protection and prevent splashing. Alternatively, the liquid flow device A-1000 may be structured not to include the shield assembly A-1800 to provide for lower costs, reduced production complexity and to allow further venting of gases directly to an exterior of the liquid flow device A-1000.

FIGS. 4A-4D illustrate a side, a top, a bottom, and a sectional view of the jet nozzle assembly A-1200 of the liquid flow device A-1000, according to certain aspects of the disclosure.

Figure 5B:
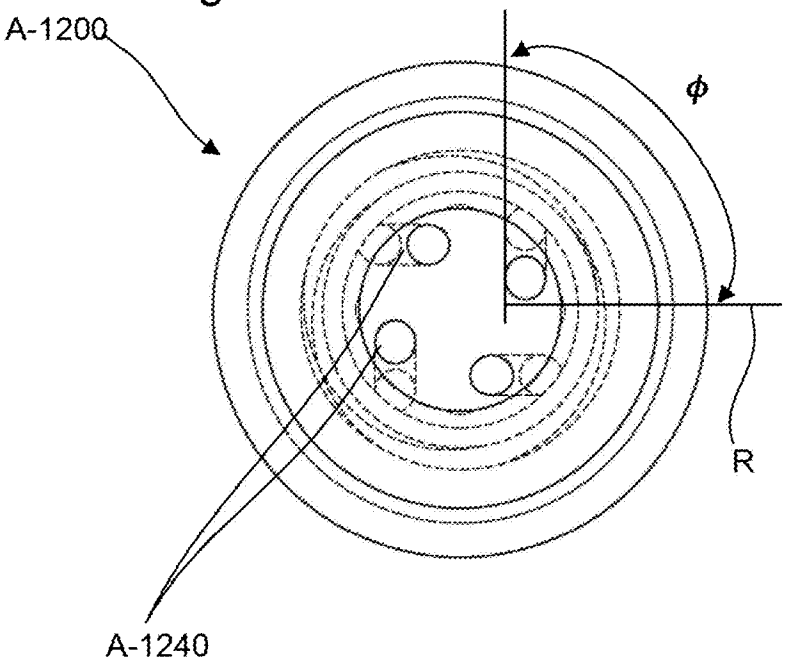
FIG. 5B is a top view of the jet nozzle assembly with the plurality of jet channels in a second configuration, according to certain aspects of the disclosure.
Figure 5A:
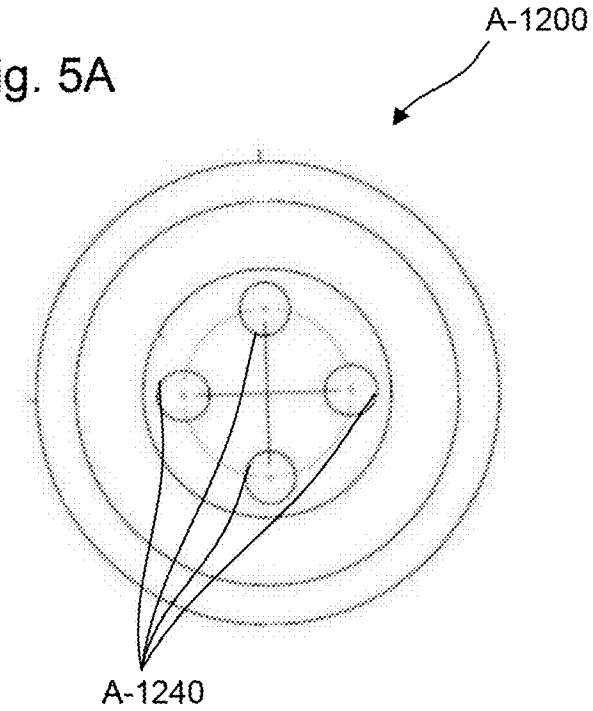
FIG. 5A is a top view of the jet nozzle assembly with a plurality of jet channels in a first configuration, according to certain aspects of the disclosure.
Figure 5D:
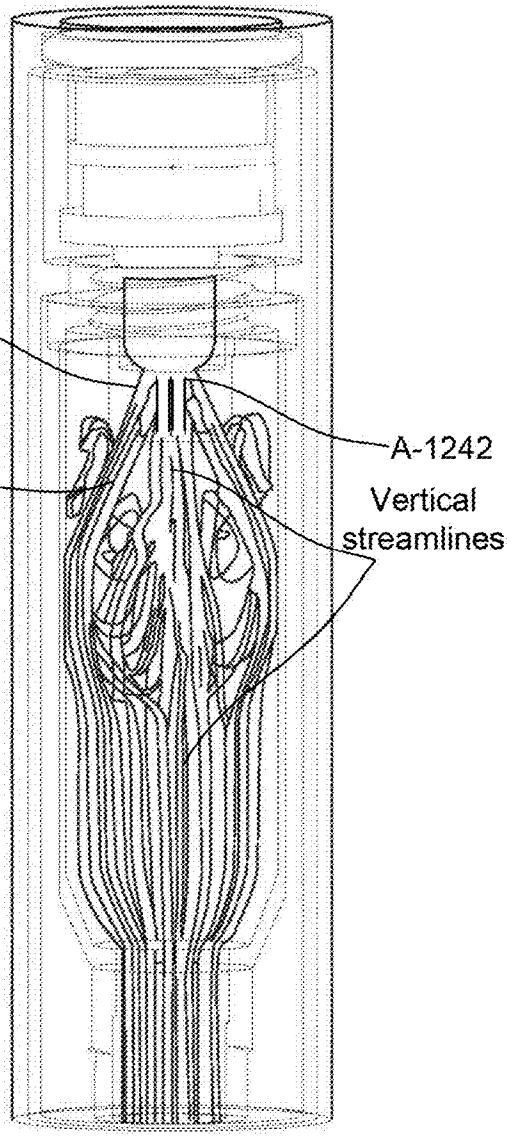
FIG. 5D is a perspective view of the liquid flow device with streamlines generated by the plurality of jet channels, according to certain aspects of the disclosure.

The jet nozzle assembly A-1200 can receive the heated fluid 10 coming from the liquid dispensing device B-1000 and pass through the inlet assembly A-1100, project the heated fluid 10 towards the disruptor body inner surface A-1320 to expand the gases present in the heated fluid 10 through liquid-surface interactions and generate a swirling flow on the heated fluid 10 that wets the disruptor body inner surface A-1320, as illustrated in FIG. 5D.

The jet nozzle assembly A-1290 can include a jet nozzle fitting A-1210, a jet nozzle flange A-1220 protruding radially from the jet nozzle fitting A-1210, a jet nozzle cavity A-1230 that faces the jet nozzle fitting A-1210, and the plurality of jet channels A-1240 that extend between the jet nozzle cavity A-1230 and the disruptor upper opening A-1310.

The jet nozzle fitting A-1210 can provide attachment between the jet nozzle assembly A-1200 and the jet nozzle housing A-1110. The jet nozzle fitting A-1210 can have a jet nozzle threaded inner surface to receive a threaded surface of the jet nozzle housing A-1110.

The jet nozzle cavity A-1230 can partially be inserted around the faucet flow conveying tube A-1120 to receive the heated fluid 10 from the faucet flow conveying tube A-1120 and act as buffer while the heated fluid 10 is evacuated from the jet nozzle assembly A 1200 through the plurality of jet channels A-1240 towards the disruptor body A-1320.

FIGS. 5A-5E are sectional views of the plurality of jet channels A-1240 in a first configuration, in a second configuration, and in the third configuration, according to certain aspects of the disclosure.

The plurality of jet channels A-1240 can be configured to provide a predetermined orientation of the jets 12 to enhance the wetting of the disruptor body inner surface A-1320 and/or the chamber body upper inner surface A-1424.

Figure 4A:
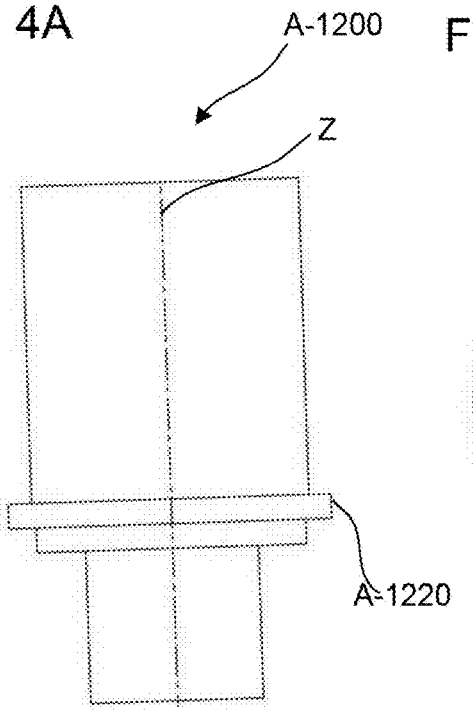
FIG. 4A is a side view of a jet nozzle assembly of the liquid flow device, according to certain aspects of the disclosure.
Figure 4B:
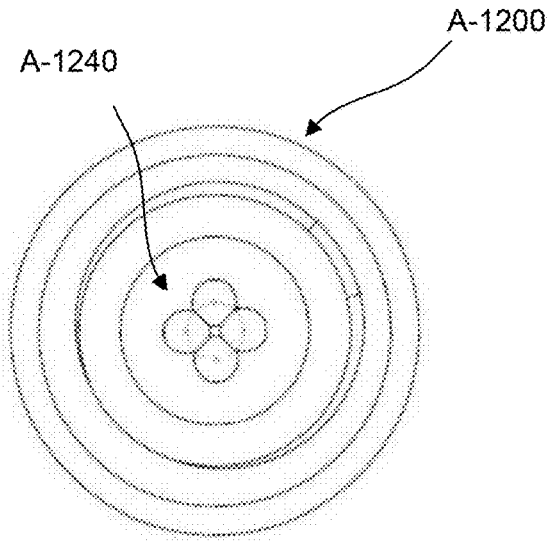
FIG. 4B is a lop view of the jet nozzle assembly, according to certain aspects of the disclosure.
Figure 4C:
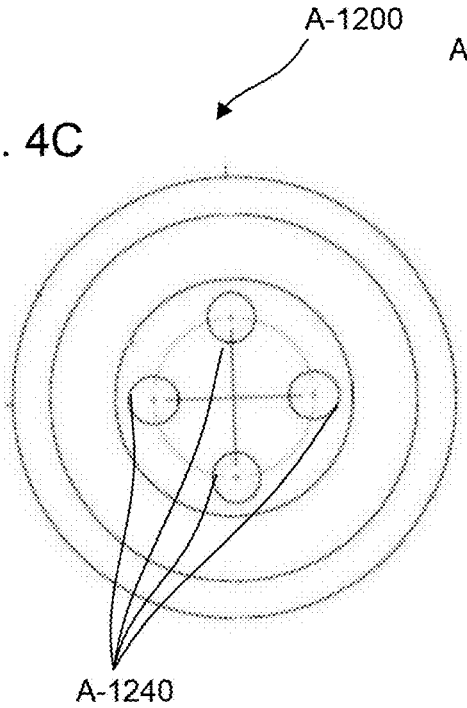
FIG. 4C is a bottom view of the jet nozzle assembly, according to certain aspects of the disclosure.
Figure 4D:
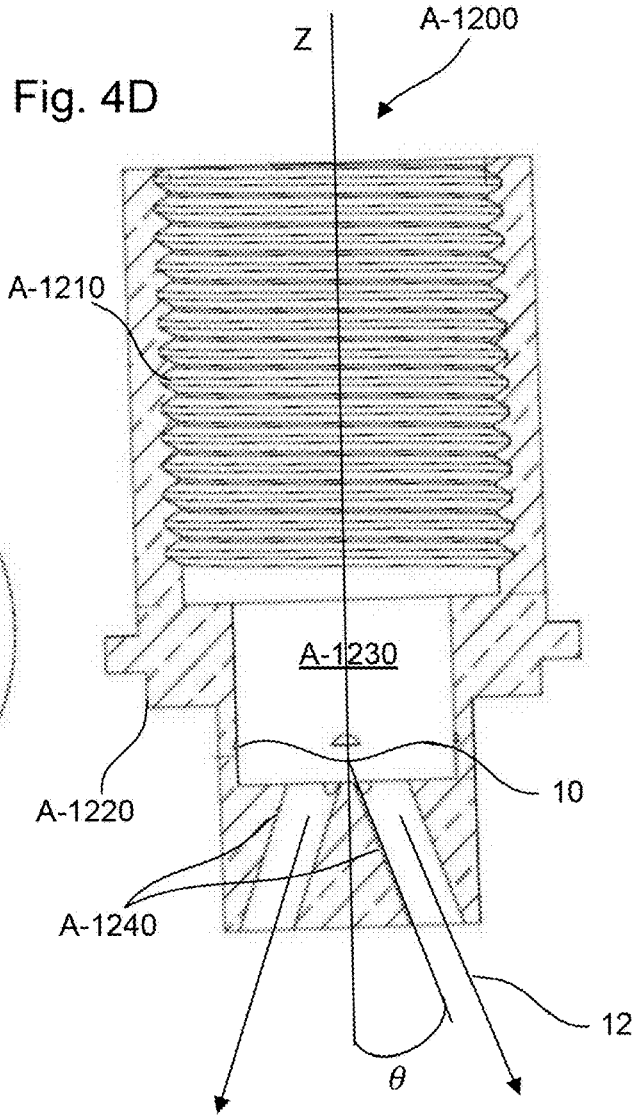
FIG. 4D is a sectional view of the jet nozzle assembly, according to certain aspects of the disclosure.

In a first configuration, the plurality of jet channels A-1240 can orient the jets 12 radially and downwardly to impact the disruptor body inner surface A-1320 with the heated fluid 10, as illustrated in FIG. 5A. In the first configuration, each jet channel of the plurality of jet channels A-1240 can be inclined from a central axis Z of the flow liquid device A-1000 with a predetermined polar angle θ, as illustrated in FIG. 4D to generate oblique streamlines that wet the chamber body upper inner surface A-1424, as illustrated in FIG. 2F. This creates a less disruptive flow of heated liquid 10 within the liquid flow device A-1000 thereby enhancing flow and reducing splashing. It also creates one or more gaps between the jets 12 exiting from the plurality of jet channels A-1240 and the plurality of core vents A-2120 to facilitate the movement of the gaseous vapor and steam through the plurality of core vents A-2120

In a second configuration, in addition to being oriented radially and downwardly, the plurality of jet channels A-1240 can be oriented azimuthally between each other to wet the chamber body upper inner surface A-1424 and generate a swirling motion on the chamber body upper inner surface A-1424, as illustrated in FIG. 5B. In the second configuration, each jet channel of the plurality of jet channels A-1240 can be inclined from a radial axis R of the flow liquid device A-1000 with an azimuthal angle ϕ.

The swirling motion can be generated by the jets 12 that tangentially approach and hit the chamber body upper inner surface A-1424. The swirling motion can force and/or push the liquid portion of the heated fluid 10 towards the chamber body upper inner surface A-1424 and creates the swirling motion of heated fluid 10 such that gaseous vapor and steam from the heated fluid 10 can expand within an interior volume of the swirling motion and expand in an upward direction to reach the plurality of core vents A-2120.

Figure 5C:
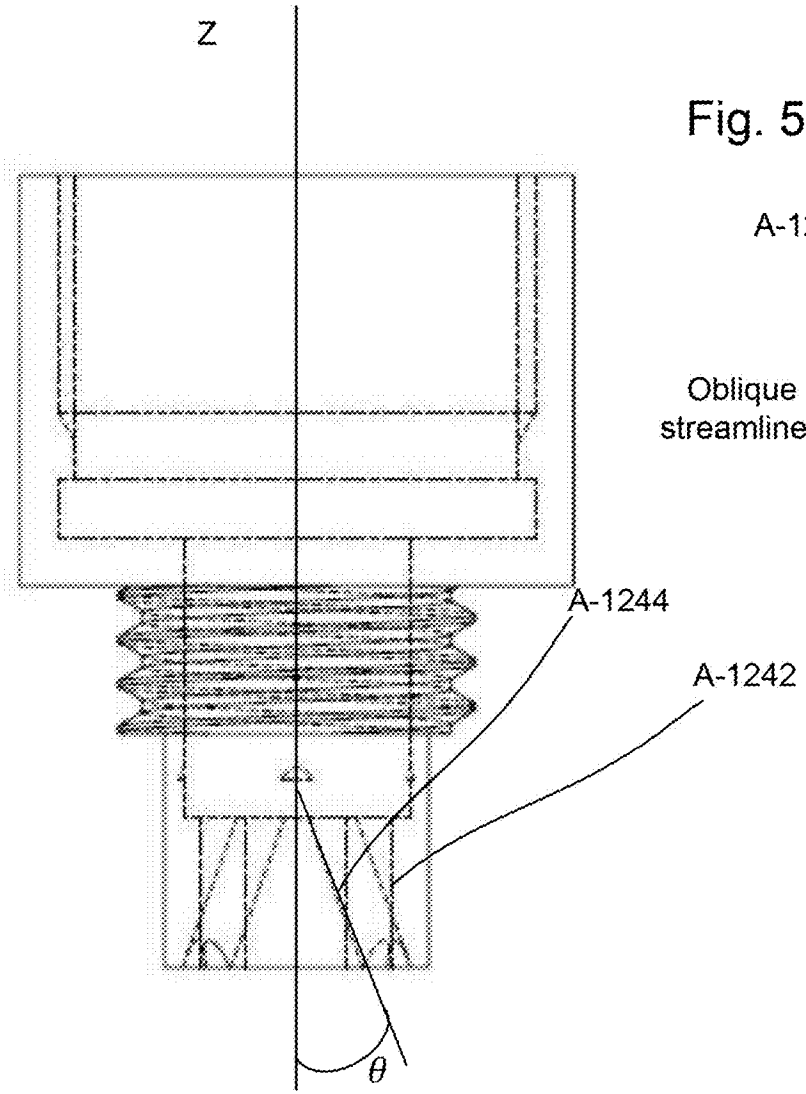
FIG. 5C is a sectional view of the jet nozzle assembly with the plurality of jet channels in a third configuration, according to certain aspects of the disclosure.
Figure 5E:
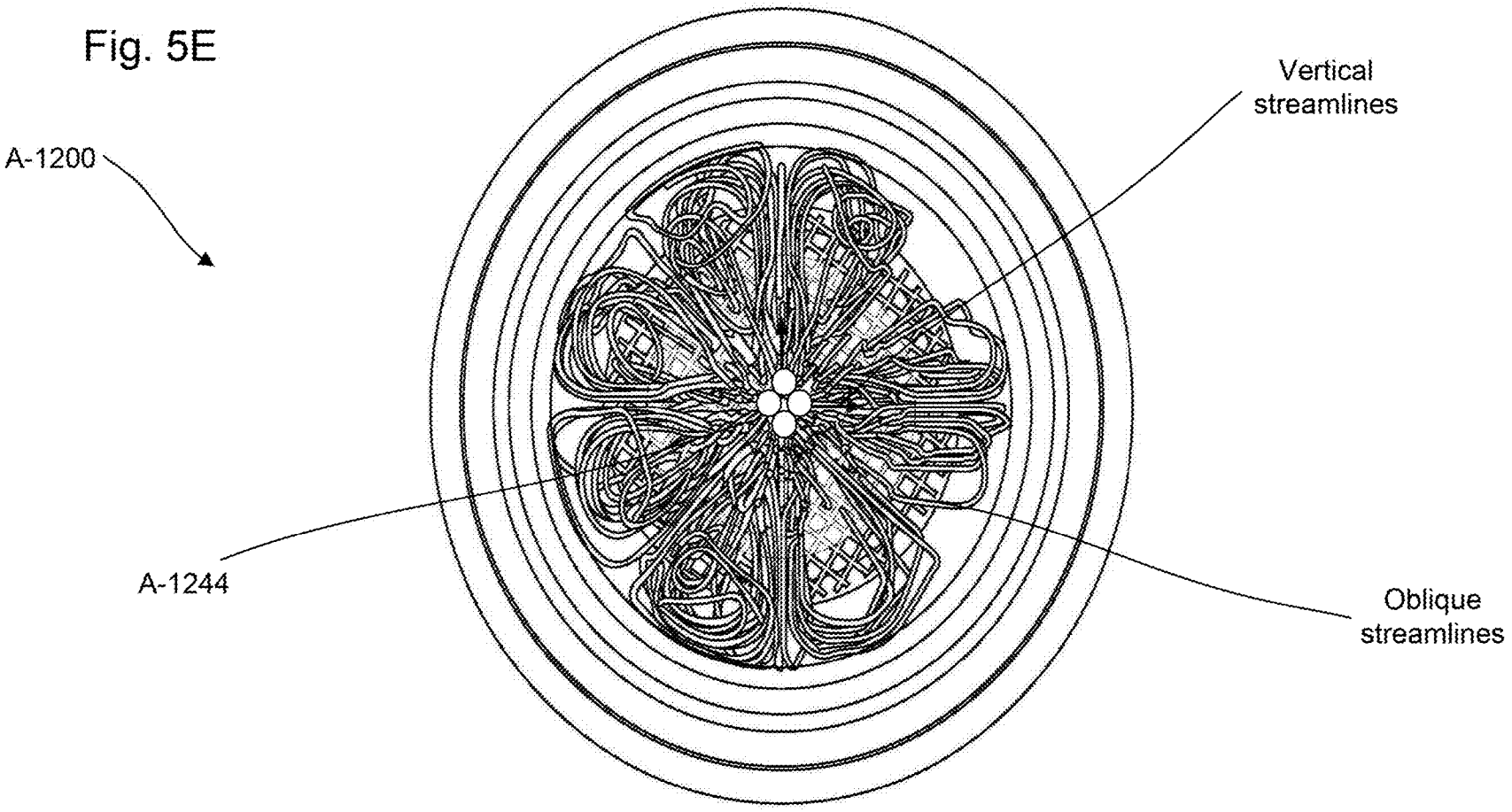
FIG. 5E is a sectional view through the jet nozzle assembly of the liquid flow device with streamlines, according to certain aspects of the disclosure.
Figure 6B:
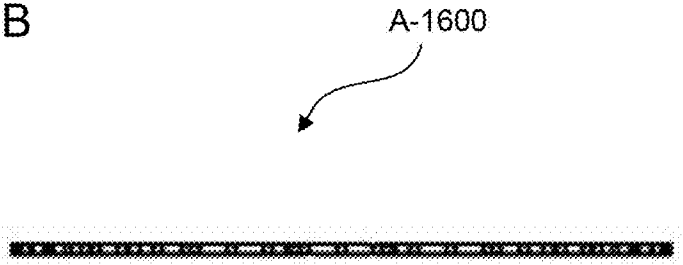
FIG. 6B is a side view of the screen assembly, according to certain aspects of the disclosure.
Figure 6A:
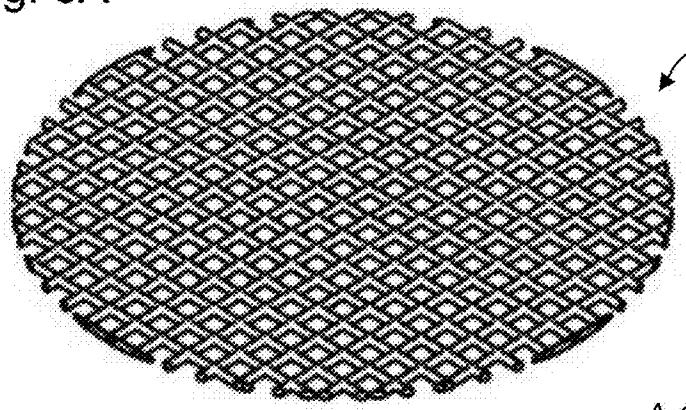
FIG. 6A is a perspective view of a screen assembly of the liquid flow device, according to certain aspects of the disclosure.
Figure 6D:
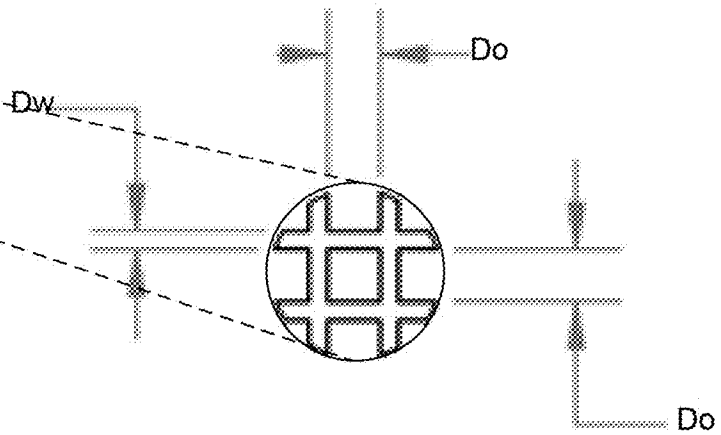
FIG. 6D is a close-up view of the screen assembly, according to certain aspects of the disclosure.
Figure 6C:
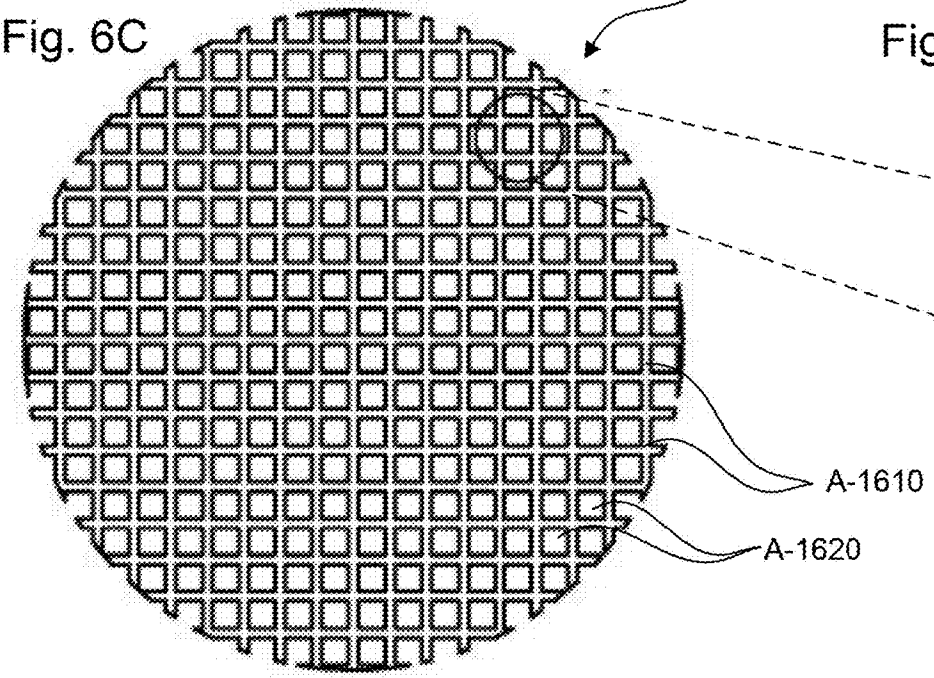
FIG. 6C is a top view of the screen assembly, according to certain aspects of the disclosure.

In a third configuration, the plurality of jet channels A-1240 can include a first plurality of jet channels A-1242 oriented substantially parallel to the central axis Z and a second plurality of jet channels A-1244 oriented in the first configuration and/or the second configuration, as illustrated in FIG. 5C.

The first plurality of jet channels A-1242 can generate substantially vertical streamlines of heated fluid 10 that flow along the central axis Z, while the second plurality of jet channels A-1244 can generate oblique streamlines that wet the chamber body upper inner surface A-1424, as illustrated in FIGS. 5D (side view) and 5E (sectional top view) thereby helping to create laminar flow of the heated fluid while separating steam and vapor from the heated liquid.

In addition, in all configurations, each jet channel A-1240 can have a substantially circular cross section, and be equidistantly positioned from each other along a circumference of the jet nozzle assembly A-1200 to uniformly wet the disruptor body inner surface A-1320 and the chamber body upper inner surface A-1424.

FIGS. 6A-6D are a perspective view, a side view, a top view, and a close-up view of the screen assembly A-1600 of the liquid flow device A-1000, according to certain aspects of the disclosure. The screen assembly A-1600 can receive the heated fluid 10 and further laminarize the heated fluid 10 before the heated fluid 10 exits the liquid flow device A-1000 through the outlet assembly A-1700. The screen assembly A-1600 can include a plurality of screen wires A-1610 meshed together to form a plurality of screen openings A-1620.

Each wire of the plurality of screen wires A-1610 can have a wire diameter Dw sufficiently large to fully wet the heated fluid 10 but sufficiently small to prevent the heated fluid 10 from accumulating and rising inside the liquid flow device A-1000 up to where the jets 12 impact the disruptor body inner surface A-1322. For example, the wire diameter Dw can be between 0.0049 in. and 0.0080 in., and preferably between 0.0058 in. and 0.0072 in.

Similarly, each opening of the plurality of screen openings A-1620 can have an opening diameter Do sufficiently small to fully wet the heated fluid 10 but sufficiently large to prevent the heated fluid 10 from accumulating and rising inside the liquid flow device A-1000 up to where the jets 12 impact the disruptor body inner surface A-1322. For example, the opening diameter Do can, be between 0.014 in. and 0.023 in., and preferably between 0.017 in. and 0.020 in.

Figure 7B:
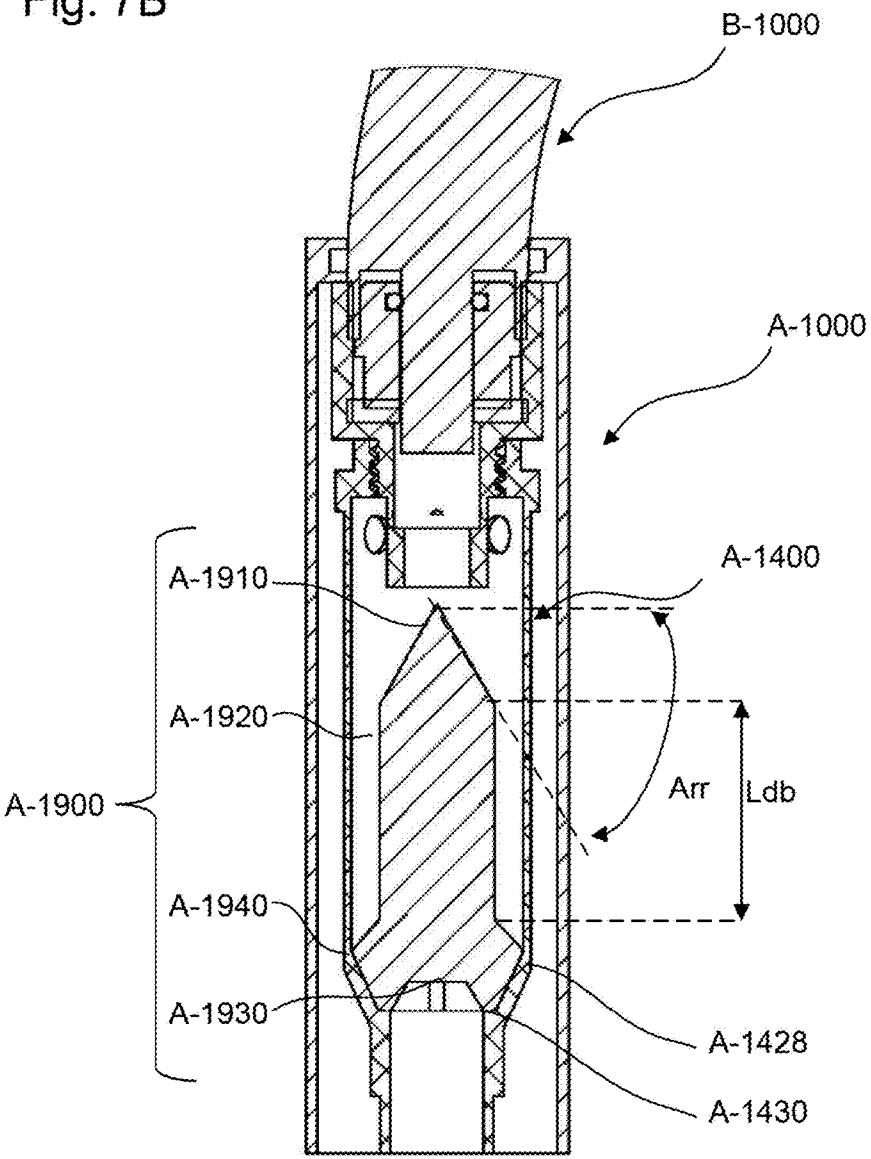
FIG. 7B is a sectional view of the liquid flow device with the diffuser assembly, according to certain aspects of the disclosure.
Figure 7A:
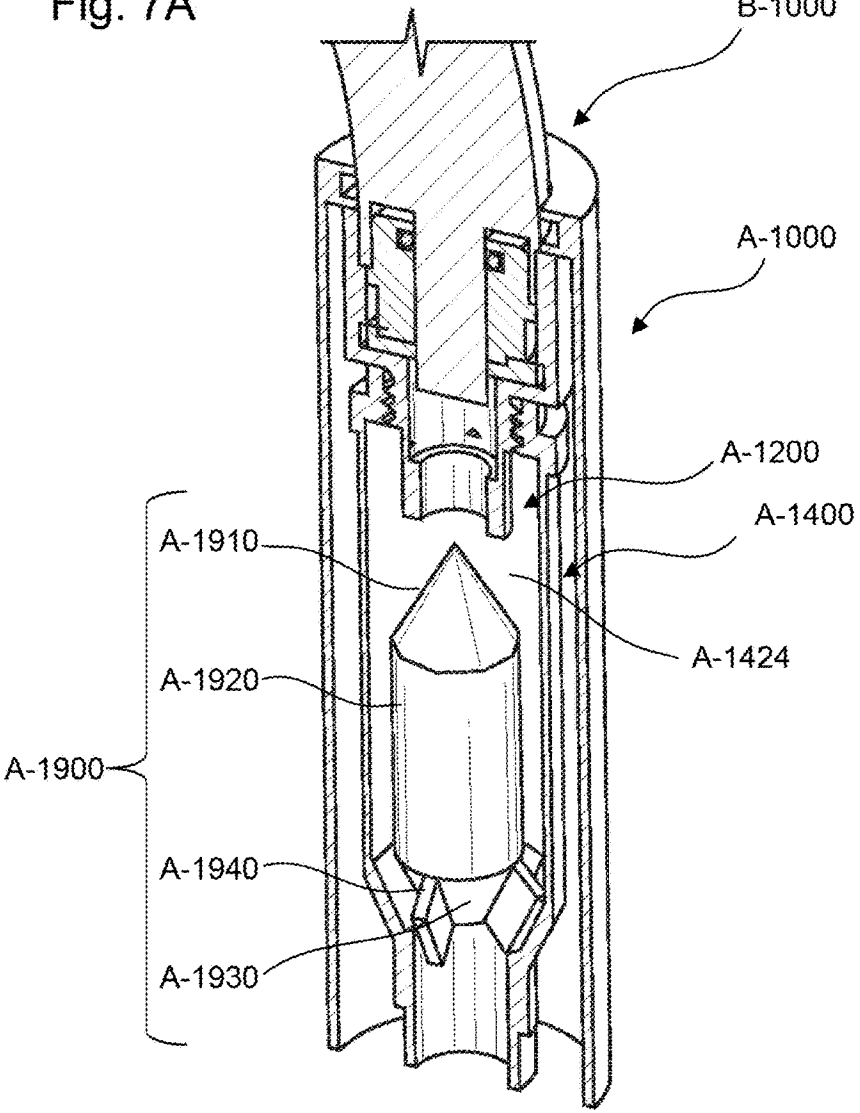
FIG. 7A is a sectional view of the liquid flow device with a diffuser assembly, according to certain aspects of the disclosure.

FIGS. 7A-7B illustrate a perspective view and a sectional view of the liquid flow device A-1000 with a diffuser assembly A-1900, according to certain aspects of the disclosure. In this example, instead of having the plurality of jet channels A-1240 and jets 12, the liquid flow device A-1000 can include a diffuser assembly A-1900 positioned in a chamber body inner volume of the chamber assembly A-1400 to prevent splashing. The diffuser assembly A-1900 can receive the heated fluid 10 from the jet nozzle assembly A-1200 and guide the hot fluid towards the chamber lower opening A-1430 to laminarize the heated fluid 10.

The diffuser assembly A-1900 can include a diffuser head A-1910 that receives the heated fluid 10, a diffuser base A-1930 that faces the chamber lower opening A-1430, a diffuser body A-1920 that extends between the diffuser head A-1910 and the diffuser base A-1930, and a plurality of diffuser fins A-1940 that protrudes radially from the diffuser base A-1930 to contact the chamber body lower inner surface A-1428.

The diffuser head A-1910 can have a substantially conical shape to receive the heated fluid 10 and distribute the heated fluid 10 on the chamber body lower inner surface A-1428 and on the diffuser body A-1920 but other shapes can also be used to distribute the heated fluid 10.

The diffuser body A-1920 can have a substantially cylindrical shape to receive the heated fluid 10 from the diffuser head A-1910 and convey the heated fluid 10 towards the diffuser base A-1930 and the plurality of diffuser fins A-1940. In addition, the diffuser body A-1920 extends between the diffuser head A-1910 and the diffuser base A-1930 at a predetermined diffuser body length Ldb to provide sufficient wetting of the chamber body upper inner surface A-1424 before the heated fluid 10 reaches the plurality of diffuser fins A-1940. For example, in one implementation, the predetermined diffuser body length Ldb can be at least half of the internal diameter Dcb of the chamber body upper portion A-1424. In addition, the diffuser head A-1910 can be characterized by a radial angle Arr formed between the diffuser head A-1910 and a horizontal plane, as illustrated in FIG. 7B, that is between 0° and 45°.

The diffuser base A-1930 and/or the plurality of diffuser fins A-1940 help restrict the heated fluid 10 that goes through the chamber lower opening A-1430 and the outlet assembly A-1700 to create a smoother flow. As such, the plurality of diffuser fins A-1940 channel the heated fluid 10 and force the heated fluid 10 to flow laminarly though the outlet assembly A-1700 of the liquid flow device A-1000.

Figure 8B:
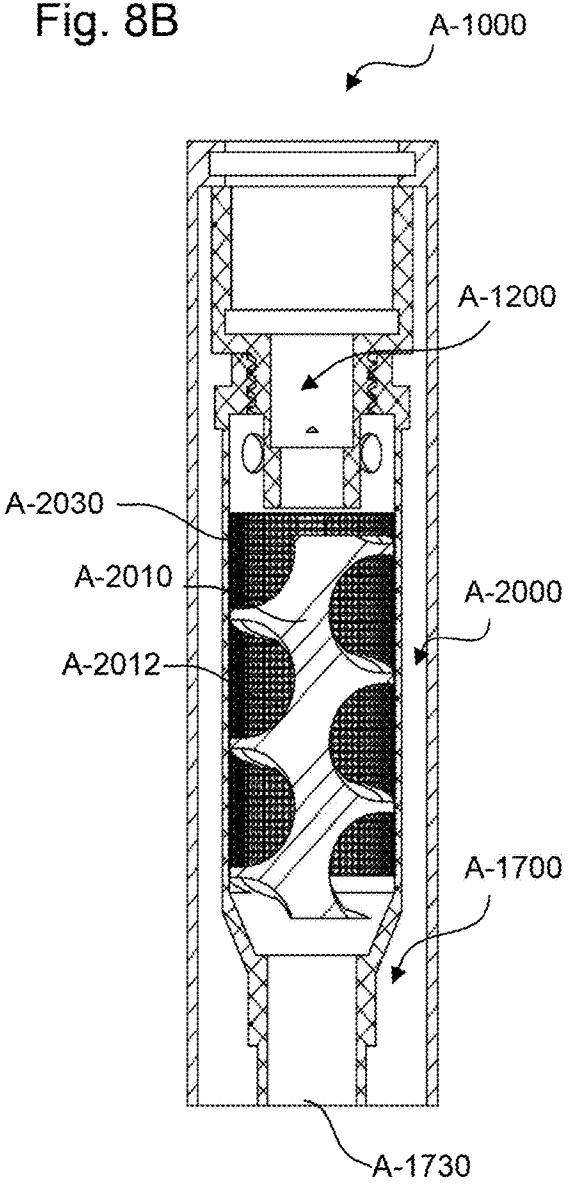
FIG. 8B is a sectional view of the liquid flow device with the swirl assembly, according to certain aspects of the disclosure.
Figure 8A:
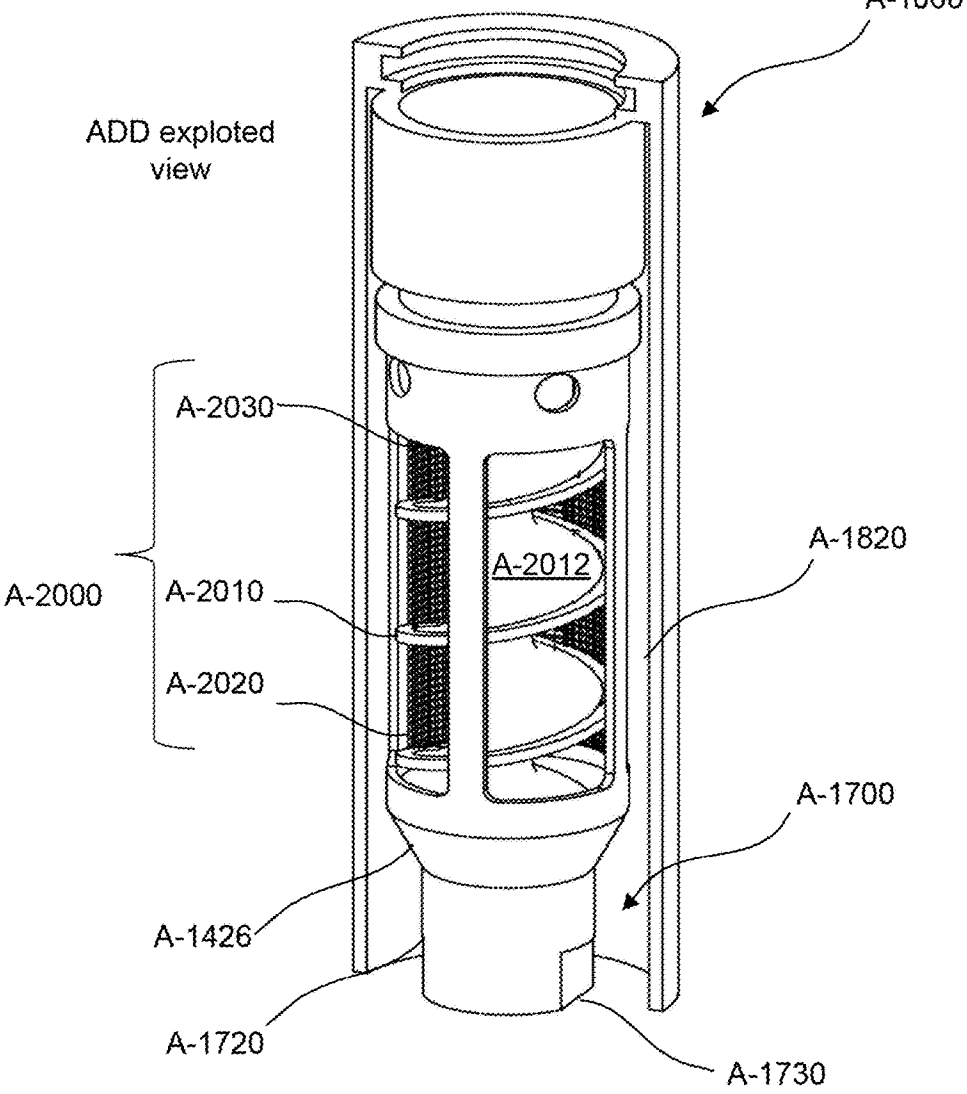
FIG. 8A is a sectional view of the liquid flow device with a swirl assembly, according to certain aspects of the disclosure.
Figure 8C:
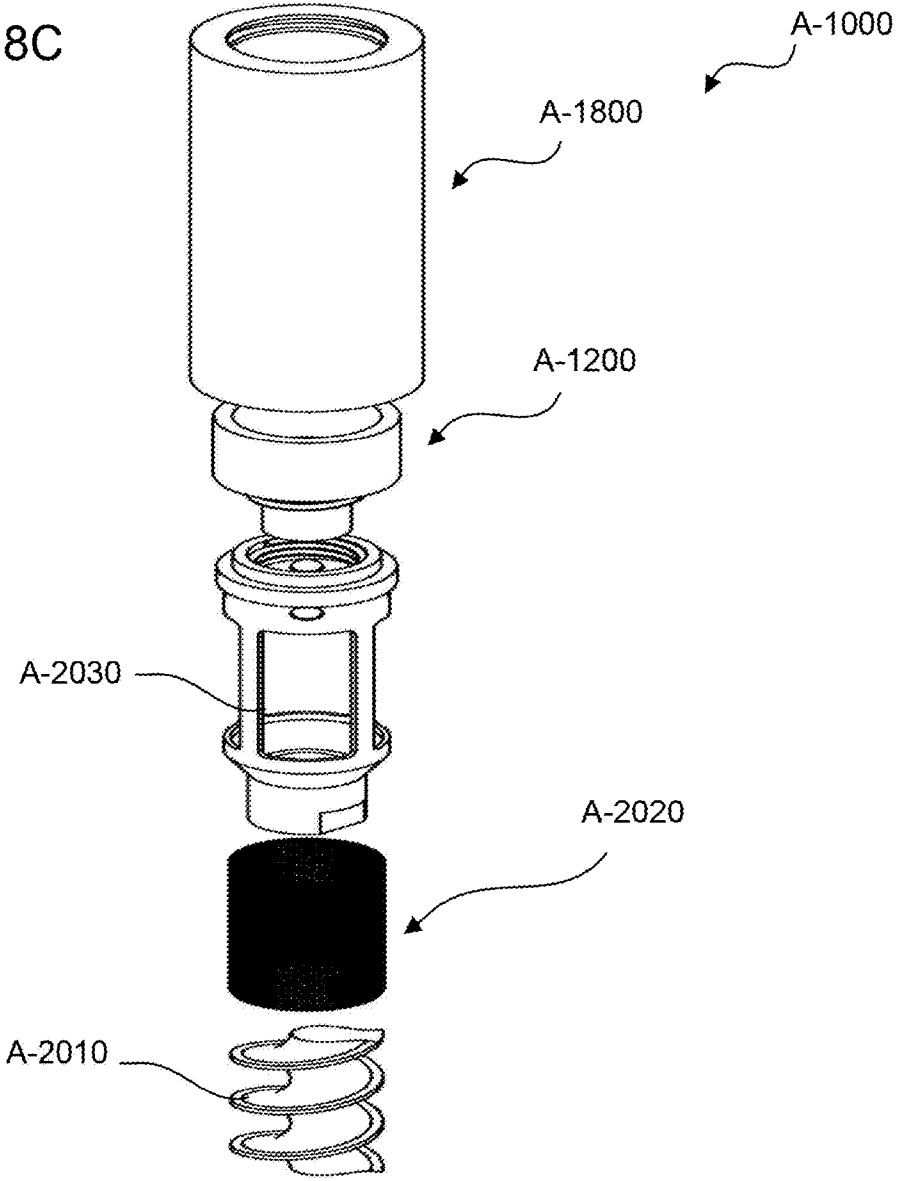
FIG. 8C is an exploded view of the liquid flow device with the swirl assembly, according to certain aspects of the disclosure.

FIGS. 8A-8C are a perspective view, a sectional view and an exploded view of the liquid flow device A-1000 with a swirl assembly A-2000, according to certain aspects of the disclosure.

Alternatively to the plurality of jet channels A-1240 and/or the diffuser assembly A-1900, the liquid flow device A-1000 can include a swirl assembly A-2000 to prevent splashing. The swirl assembly A-2000 can receive the heated fluid 10 from the jet nozzle assembly A-1200, and force the heated fluid 10 to swirl from the jet nozzle assembly A-1200 to the chamber lower opening A-1430 to laminarize the heated fluid 10.

The swirl assembly A-2000 can include a swirl body A-2010 that extends between the jet nozzle assembly A-1200 and the outlet assembly A-1700, a swirl screen A-2020 that surrounds the swirl body A-2010, and a plurality of swirl windows A-2030 that face the swirl screen A-2020 and open the chamber body upper portion A-1422. Alternatively, in one example, the swirl assembly A-2000 may not include the swirl screen A-2020.

The swirl body A-2010 can have a helical surface A-2012 that receives the heated fluid 10 and forces the heated fluid 10 to flow from the jet nozzle assembly A-1200 to the outlet assembly A-1700 in a swirling motion to be projected on the swirl screen A-2020.

The swirl screen A-2020 can provide wetting of the heated fluid 10 while the plurality of swirl windows A-2030 provide radial escape for the heated fluid 10 and allow the hot fluid to wet the shield outer sheath A-1820.

Figure 9A:
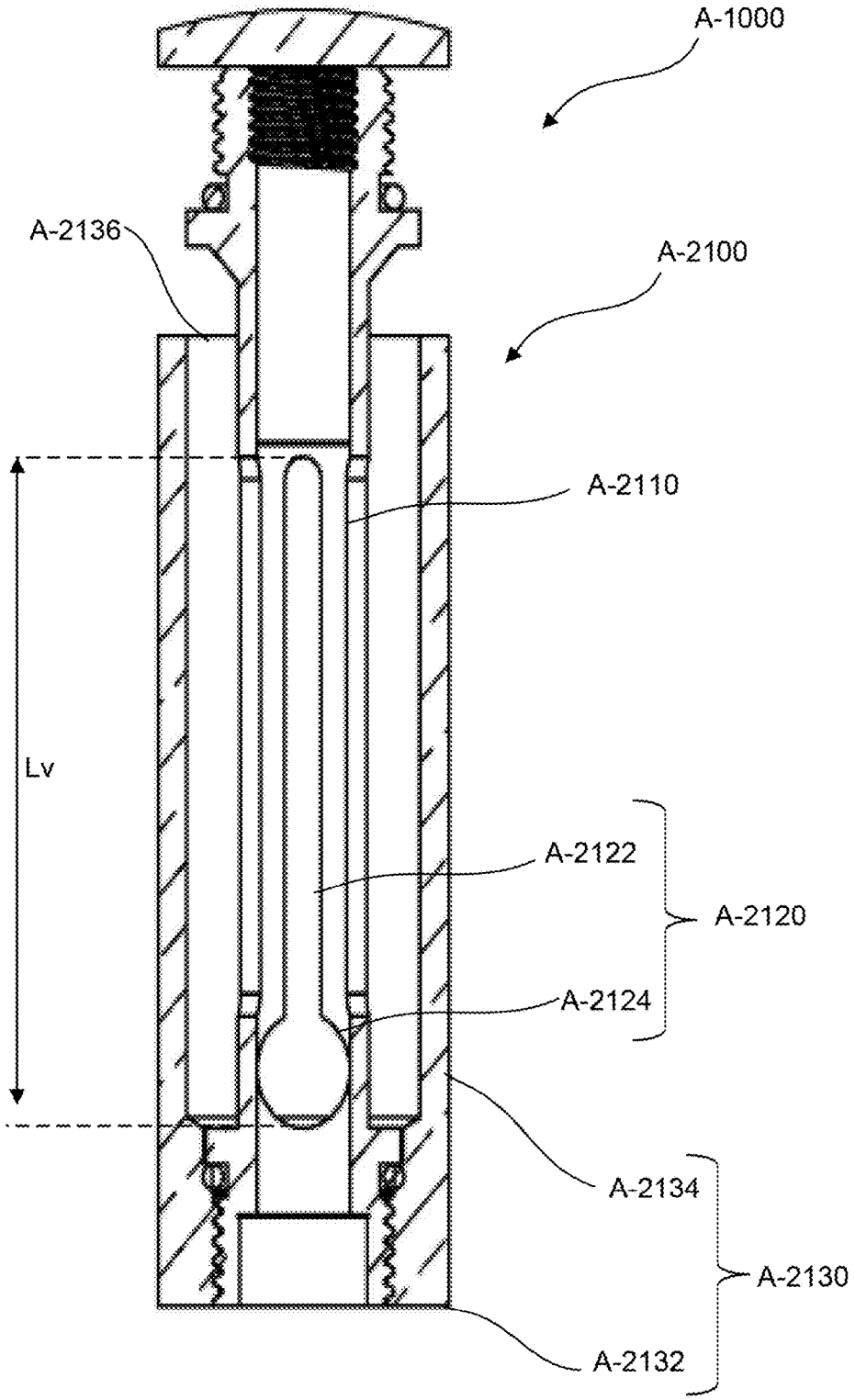
FIG. 9A is a sectional view of the liquid flow device with a core assembly, according to certain aspects of the disclosure.
Figure 9B:
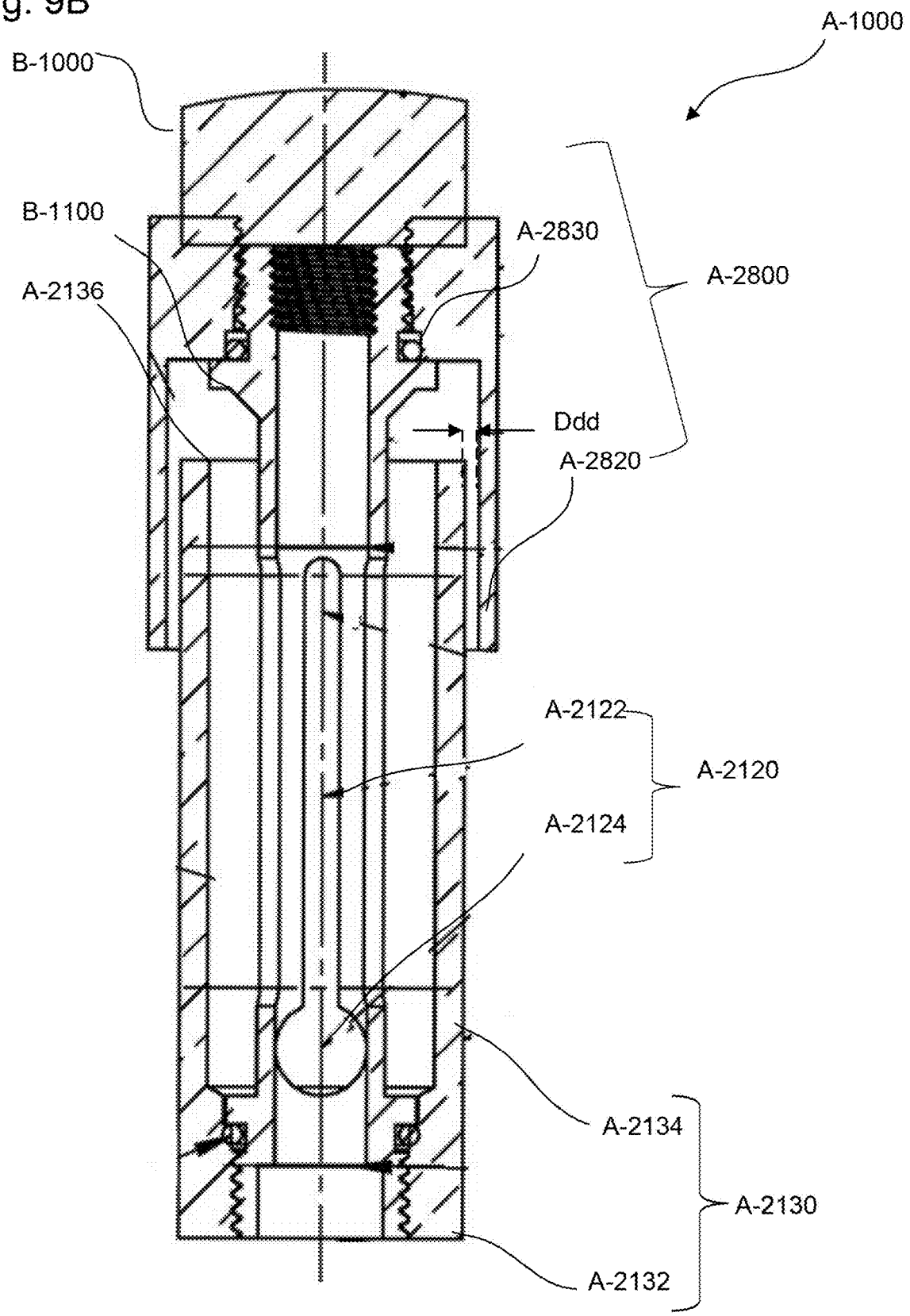
FIG. 9B is a sectional view of the liquid flow device with a core assembly and a shield assembly, according to certain aspects of the disclosure.

FIGS. 9A and 9B are sectional views of the liquid flow device A-1000 with a core assembly A-2100 and with a shield assembly A-2800, respectively, according to certain aspects of the disclosure.

Alternatively to the plurality of jet channels A-1240, the diffuser assembly A-1900, and/or the swirl assembly A-2000, the liquid flow device A-1000 can include a core assembly A-2100 to prevent splashing.

The core assembly A-2100 can channel the heated fluid 10 along the liquid flow device A-1000, expand gases present in the heated fluid 10, and larninarize the heated fluid 10.

Figure 2A:
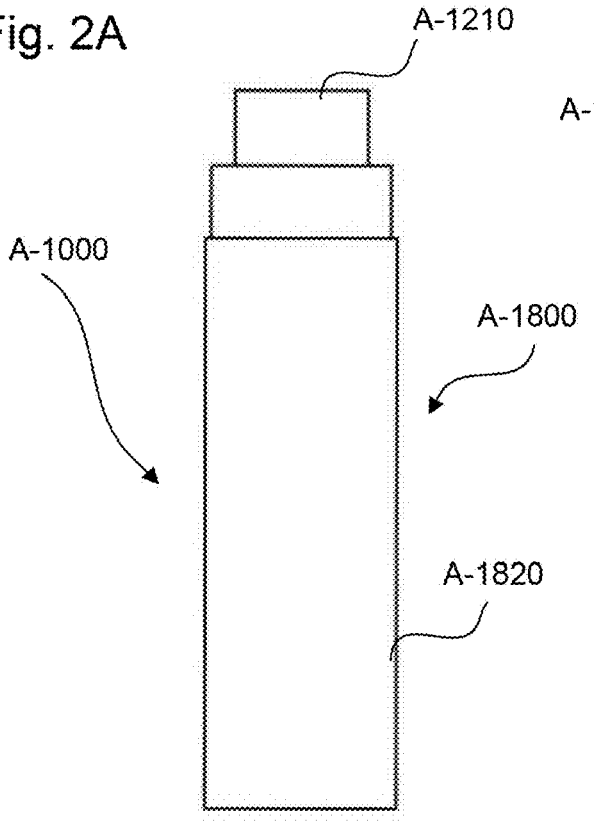
FIG. 2A is a side view of a liquid flow device of the liquid dispensing; system, according to certain aspects of the disclosure.
Figure 2B:
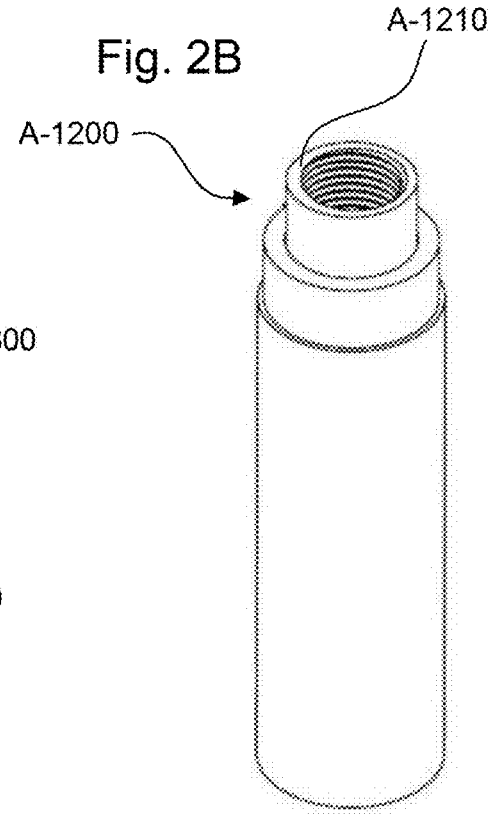
FIG. 2B is a top perspective view of the liquid flow device, according to certain aspects of the disclosure.
Figure 2C:
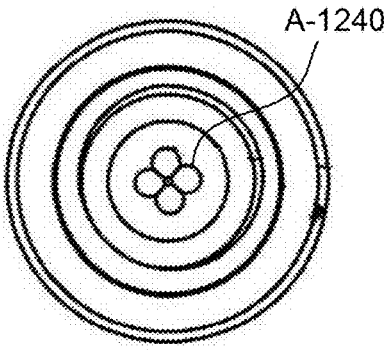
FIG. 2C is a bottom view of the liquid flow device, according to certain aspects of the disclosure.
Figure 2D:
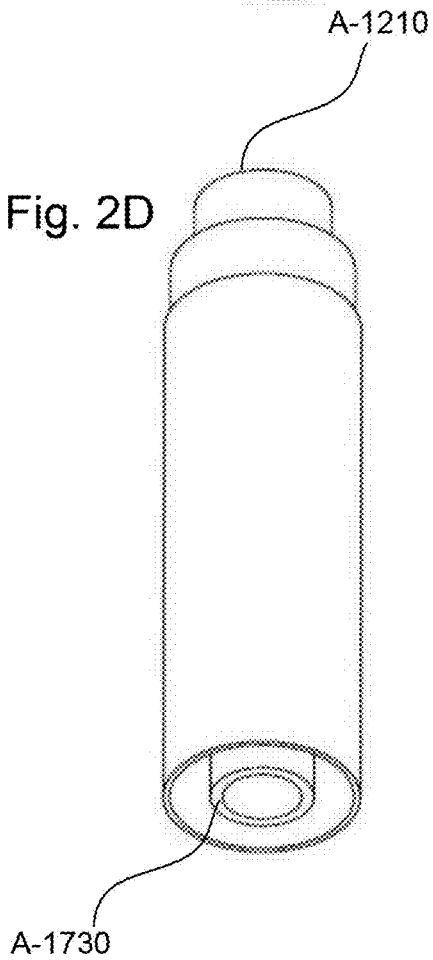
FIG. 2D is a bottom perspective view of the liquid flow device, according to certain aspects of the disclosure.
Figure 2E:
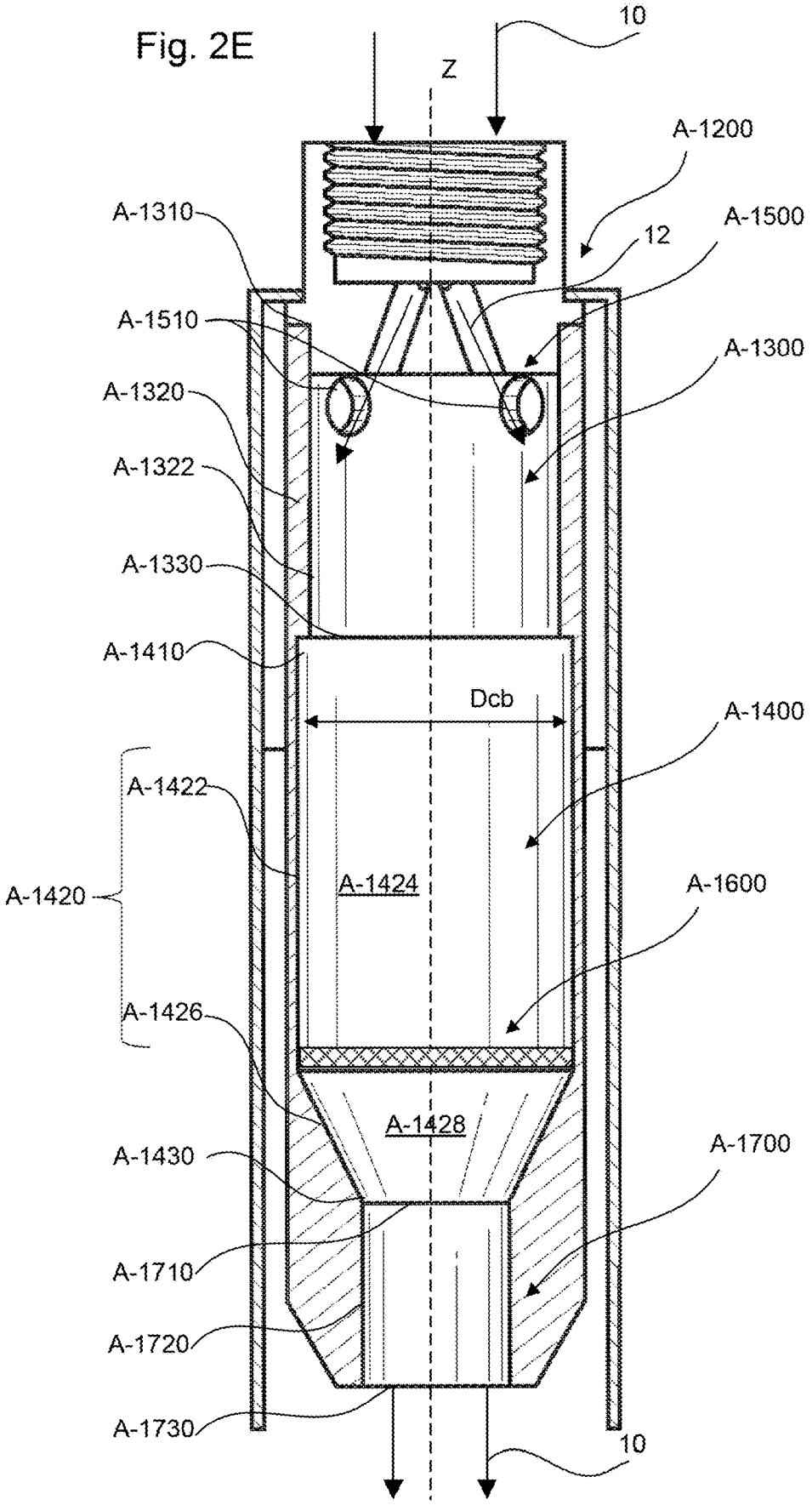
FIG. 2E is a sectional view of the liquid flow device, according to certain aspects of the disclosure.
Figure 2F:
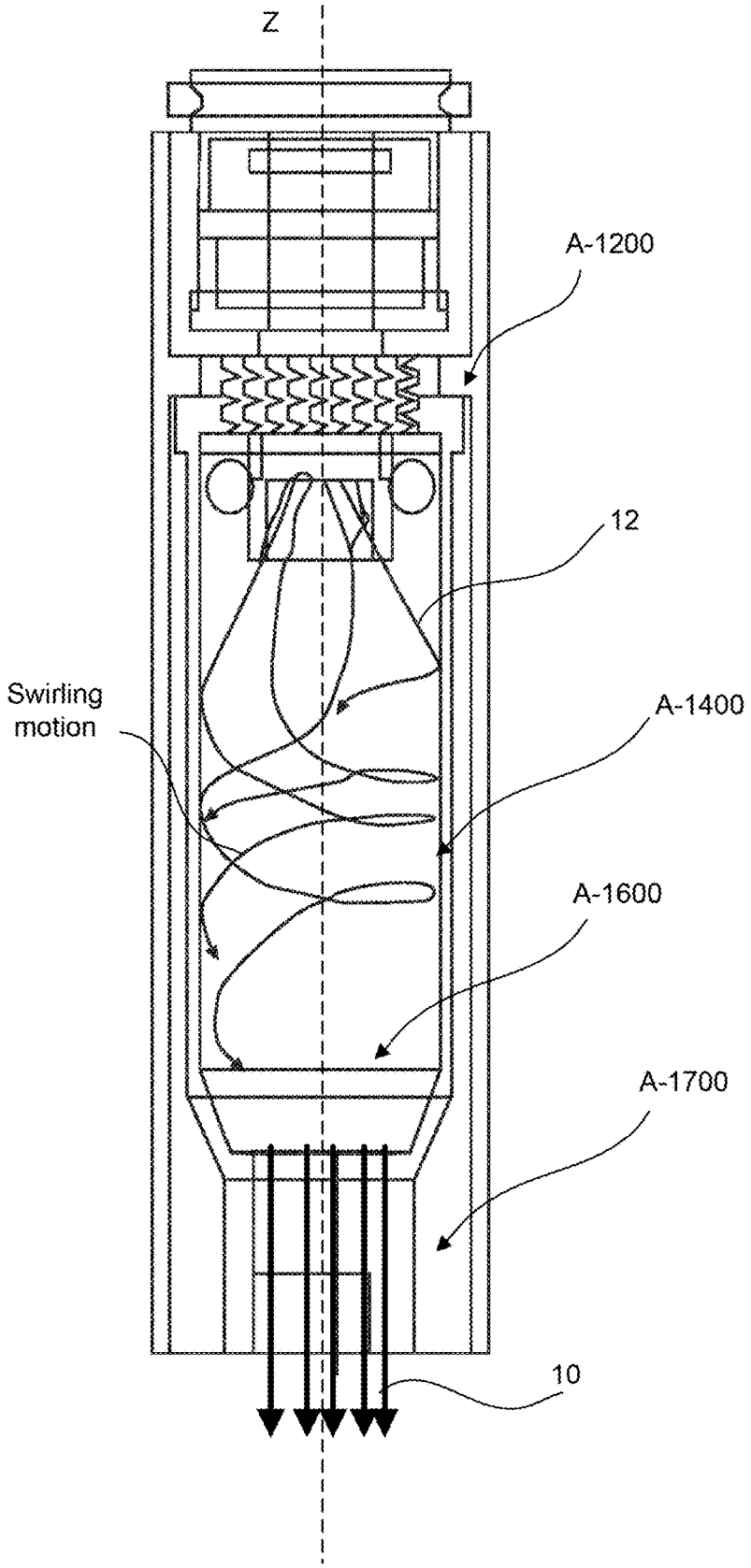
FIG. 2F is a sectional view of the liquid flow device with streamlines, according to certain aspects of the disclosure.

The core assembly A-2100 can include a core channel A-2110 that extends from the jet nozzle assembly A-1200 to the screen assembly A-1600, a plurality of core vents A-2120 positioned on a lower portion of the core channel A-2110, and a core housing A-2130 that surrounds the core channel A-2110 and the plurality of core vents A-2120 as well as extends from the screen assembly A-1600 to the jet nozzle assembly A-1200 (see FIG. 2E). The core channel A-2110 can guide the heated fluid 10 longitudinally from the jet nozzle assembly A-1200 to the screen assembly A-1600 and the outlet assembly A-1700.

The plurality of core vents A-2120 can provide radial evacuation from the gases present in the heated fluid 10. The plurality of core vents A-2120 can include a plurality oblong vent holes A-2122 that open the core channel A-2110 and a plurality of circular vent holes A-2124 that open a lower portion of the core channel A-2110 and extend to the plurality of oblong vent holes A-2122 along a predetermined vent hole length Lv.

The core housing A-2130 can include a core housing lower wall A-2132 that protrudes radially from the core channel A-2110 and below the plurality of circular vent holes A-2124, a core housing upper outlet A-2136 positioned above the plurality of core vents A-2120 and below the inlet assembly A-1100, and a core housing wall A-2134 that extends between the core housing lower wall A-2132 and the core housing upper outlet A-2136 and faces the plurality of vent holes A-2120.

The core housing A-2130 can provide expansion for the gases that escape thorough the plurality of core vents A-2120 and rise from the core housing lower wall A-2132 to the core housing upper outlet A-2136 and along the core housing wall A-2134.

In one example, a shield assembly A-2800 can be implemented with the core assembly A-2100 to prevent splashing in upward direction from occurring, as illustrated in FIG. 9B. The shield assembly A-2800 can include a shield outer sheath A-2820 that extends partially along the core housing wall A-2134 with a predetermined spacing Ddd between the shield outer sheath A-2820 and the core housing wall A-2134 to provide escape for vapors and steam, and a shield outer sheath ring A-2830 positioned between the dispensing outlet assembly B-1100 of the liquid dispensing device B-1000 and an upper portion of the shield outer sheath A-2820.

In addition to preventing splashing, the shield outer sheath A-2820 can cover outer surfaces of the shield core housing wall A-2134 and the liquid dispensing device B-1000 to further enhance thermal protection and prevent injuries.

Accordingly, the advancements described herein provide for a liquid flow device that reduces flow disruptions to provide a smooth flow of water without splashing. This also provides safety advantages by reducing the risk of a user getting scalded with hot water. Further, as gases can be vented within the liquid flow device, the risk of behind scalded by steam is eliminated. Additionally, the compact design of the liquid flow device provides for effective and efficient manufacturing while also providing for the ability to easily connect to a variety of liquid dispensing devices.

The foregoing discussion discloses and describes merely exemplary embodiments of an object of the present disclosure. As will be understood by those skilled in the art, an object of the present disclosure may be embodied in other specific forms without departing from the spirit or essential characteristics thereof. Accordingly, the present disclosure is intended to be illustrative, but not limiting of the scope of an object of the present disclosure as well as the claims.

Numerous modifications and variations on the present disclosure are possible in light of the above teachings. It is therefore to be understood that within the scope of the appended claims, the disclosure may be practiced otherwise than as specifically described herein.

What is claimed is:

1. A liquid flow device to receive fluid and laminarize the fluid flow, the device comprising:

a jet nozzle assembly to receive the fluid and direct the fluid through a plurality of jet channels;

a flow disruptor assembly to receive the fluid from the jet nozzle assembly to generate a flow path of the fluid, wherein the plurality of jet channels include one or more jet channels that project radially from the jet nozzle assembly into the flow disruptor assembly;

a chamber assembly connected to the flow disruptor to receive and expand the fluid from the flow disruptor assembly; and an outlet assembly open to an external environment to receive the fluid from the chamber assembly and output the fluid with a laminar flow pattern.

2. The liquid flow device of claim 1, wherein the plurality of jet channels include one or more jet channels that project in parallel from the jet nozzle assembly.

3. The liquid flow device of claim 1, wherein each of the plurality of j et channels project radially outward from the jet nozzle assembly.

4. The liquid flow device of claim 1, wherein the jet nozzle assembly further includes a jet nozzle fitting to provide attachment between the jet nozzle assembly and a heating device.

5. The liquid flow device of claim 4, wherein the jet nozzle assembly further includes a jet nozzle cavity to buffer the fluid before being directed to the plurality of jet channels.

6. The liquid flow device of claim 1, wherein the liquid flow device further includes a plurality of vent holes positioned radially around the flow disruptor assembly.

7. The liquid flow device of claim 6, wherein the plurality of vent holes are positioned above a distal end of the plurality of jet channels.

8. The liquid flow device of claim 6, wherein the liquid flow device further includes a shield assembly disposed around and enclosing the plurality of vent holes.

9. The liquid flow device of claim 8, wherein the shield assembly includes a shield insulating sheath that partially encloses the liquid flow device.

10. The liquid flow device of claim 1, further including a screen assembly between the chamber assembly and the outlet assembly.

11. The liquid flow device of claim 10, wherein the screen assembly includes a plurality of wiring connected in a lattice structure to enhance the laminar flow of the liquid.

12. The liquid flow device of claim 1, wherein the outlet assembly is conically shaped to provide additional laminar flow characteristics to the fluid.

13. The liquid flow device of claim 1, wherein the chamber assembly further includes a diffuser assembly configured to provide laminar flow of the fluid by channeling the fluid towards opposing surfaces of the chamber assembly.

14. The liquid flow device of claim 13, wherein the diffuser assembly extends along a length of the chamber assembly and includes a conically shaped head at a first end closest to the plurality of jet channels.

15. The liquid flow device of claim 13, wherein the diffuser assembly further includes a plurality of fins that protrude radially from the diffuser assembly at a second end closest to the output assembly.

16. A liquid dispensing system, comprising:

a heating device to receive fluid and output a heated fluid; and a liquid flow device configured to receive the heated fluid from the heating device and laminarize the heated fluid, the liquid flow device including:

a jet nozzle assembly to receive the heated fluid from the heating device and direct the heated fluid through a plurality of j et channels, a flow disruptor assembly to receive the heated fluid from the jet nozzle assembly to generate a flow path of the heated fluid, a chamber assembly connected to the flow disruptor to receive the heated fluid from the flow disruptor assembly, and an outlet assembly open to an external environment to receive the heated fluid from the chamber assembly and output the heated fluid with a laminar flow pattern.

17. The liquid dispensing system of claim 16, further including a liquid dispensing device connected between the heating device and liquid flow device.

18. The liquid dispensing system of claim 16, wherein the plurality of jet channels include one or more jet channels that project radially from the jet nozzle assembly into the flow disruptor assembly.

19. The liquid flow device of claim 18, wherein the plurality of jet channels include one or more jet channels projected in parallel from the jet nozzle assembly.

* * * * *